US007734216B2

(12) United States Patent
Itabashi et al.

(10) Patent No.: US 7,734,216 B2
(45) Date of Patent: Jun. 8, 2010

(54) CARTRIDGE AND IMAGE FORMING APPARATUS WITH DISCHARGE ELECTRODE DETACHABLY ATTACHED TO A FRAME

(75) Inventors: Nao Itabashi, Nagoya (JP); Tsutomu Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 507 days.

(21) Appl. No.: 11/387,749

(22) Filed: Mar. 24, 2006

(65) Prior Publication Data

US 2006/0233568 A1 Oct. 19, 2006

(30) Foreign Application Priority Data

Mar. 28, 2005 (JP) ..... 2005-092119

(51) Int. Cl.
*G03G 21/16* (2006.01)

(52) U.S. Cl. ..... 399/111; 399/115; 399/168; 399/171; 399/172

(58) Field of Classification Search ..... 399/111, 399/115, 168, 171–172
See application file for complete search history.

(56) References Cited

U.S. PATENT DOCUMENTS 4,550,253 A * 10/1985 Hashimoto ..... 250/326
4,984,018 A * 1/1991 Andou et al. ..... 399/111
5,774,324 A * 6/1998 Hayashi et al. ..... 399/171
5,845,179 A * 12/1998 Damji et al. ..... 399/171
5,909,608 A * 6/1999 Manno et al. ..... 399/173
6,249,660 B1 * 6/2001 Matsushita et al. ..... 399/115
6,393,237 B1 * 5/2002 Shindo ..... 399/171
6,735,407 B2 * 5/2004 Chavez et al. ..... 399/172
7,420,169 B2 * 9/2008 Parks et al. ..... 399/115
2003/0190171 A1 * 10/2003 Yuge ..... 399/115
2004/0047653 A1 * 3/2004 Chavez et al. ..... 399/171

FOREIGN PATENT DOCUMENTS

JP 4-18571 1/1992
JP 9-68848 3/1997

* cited by examiner

*Primary Examiner*—David M Gray
*Assistant Examiner*—Ryan D Walsh
(74) *Attorney, Agent, or Firm*—Banner & Witcoff, Ltd.

(57) ABSTRACT

A cartridge may include a frame; a photosensitive member that is rotatably supported about a rotation axis inside the frame; a discharge induction electrode that is supported inside the frame and detachably attachable to the frame from outside the frame in a direction perpendicular to the rotation axis of the photosensitive member; and a discharge electrode that is supported inside the frame opposite the discharge induction electrode and detachably attachable to the frame from outside the frame in the direction perpendicular to the rotation axis of the photosensitive member. The discharge electrode may be detachably attachable to the frame independent of the discharge induction electrode when the discharge induction electrode is supported inside the frame.

12 Claims, 14 Drawing Sheets

CARTRIDGE AND IMAGE FORMING APPARATUS WITH DISCHARGE ELECTRODE DETACHABLY ATTACHED TO A FRAME

CROSS REFERENCE TO RELATED APPLICATION

This application claims priority from Japanese Patent Application No. 2005-92119, filed on Mar. 28, 2005, the entire subject matter of which is incorporated herein by reference.

BACKGROUND

A known electrophotographic image forming apparatus includes a photosensitive drum, a charger, and a transfer roller. The charger charges a surface of the photosensitive drum, the charged surface of the photosensitive drum is irradiated with a laser beam, and an electrostatic latent image is formed on the surface of the photosensitive drum. Toner is applied to the electrostatic latent image, and the electrostatic latent image is developed into a toner image on the surface of the photosensitive drum. The toner image on the photosensitive drum is transferred to a recording medium such as a sheet of paper by a transfer roller, the transferred image is fixed by heat onto the recording medium by a fixing device, and thus the image is printed.

In addition, such an image forming apparatus is generally structured to unitize a photosensitive drum, a charger, a transfer roller and other parts into a removable cartridge for easy exchange of consumables.

The charger includes a discharge electrode that generates a corona discharge and a discharge induction electrode. The discharge electrode may be a wire. The discharge induction electrode is spaced from the discharge electrode. The charger is designed to charge the photosensitive drum by the corona discharge from the discharge electrode. The charger thus designed needs exchanging regularly because it deteriorates with use or mainly a discharging performance lowers due to adhesion of silica to the discharge electrode.

Japanese Laid-Open Patent Application No. 9-68848 discloses a structure that enables only a charger to be removed from a process cartridge.

The discharge electrode of the charger is subjected to application of higher voltage (or discharge bias) and deteriorates rapidly compared with the discharge induction electrode. Conversely, the discharge induction electrode of the charger is less prone to deteriorate and has a longer service life compared with the discharge electrode. However, the structure disclosed in Japanese Laid-Open Patent Application No. 9-68848 requires exchange of a whole charger. This means that the discharge induction electrode should be exchanged along with the discharge electrode even if it is still available, with the result that the discharge induction electrode is not used effectively.

SUMMARY

Aspects of the invention provide a cartridge including a discharge electrode and a discharge induction electrode, which is designed to make effective use of parts.

According to one illustrative aspect of the invention, a cartridge may include a frame; a photosensitive member that is rotatably supported inside the frame; a discharge induction electrode that is supported inside the frame and detachably attachable to a rotary shaft of the photosensitive member from outside the frame in a first direction perpendicular to the rotary shaft of the photosensitive member; and a discharge electrode that is supported inside the frame opposite to the discharge induction electrode and detachably attachable to the rotary shaft of the photosensitive drum from outside the frame in the first direction. The discharge electrode may be detachably attachable to the frame independently of the discharge induction electrode when the discharge induction electrode is supported inside the frame.

BRIEF DESCRIPTION OF THE DRAWINGS

Illustrative aspects of the invention will be described in detail with reference to the following figures wherein.

DETAILED DESCRIPTION

It is noted that various connections are set forth between elements in the following description. It is noted that these connections in general and, unless specified otherwise, may be direct or indirect and that this specification is not intended to be limiting in this respect.

General Structure

Illustrative aspects of the invention will be described in detail with reference to drawings.

Figure 1:
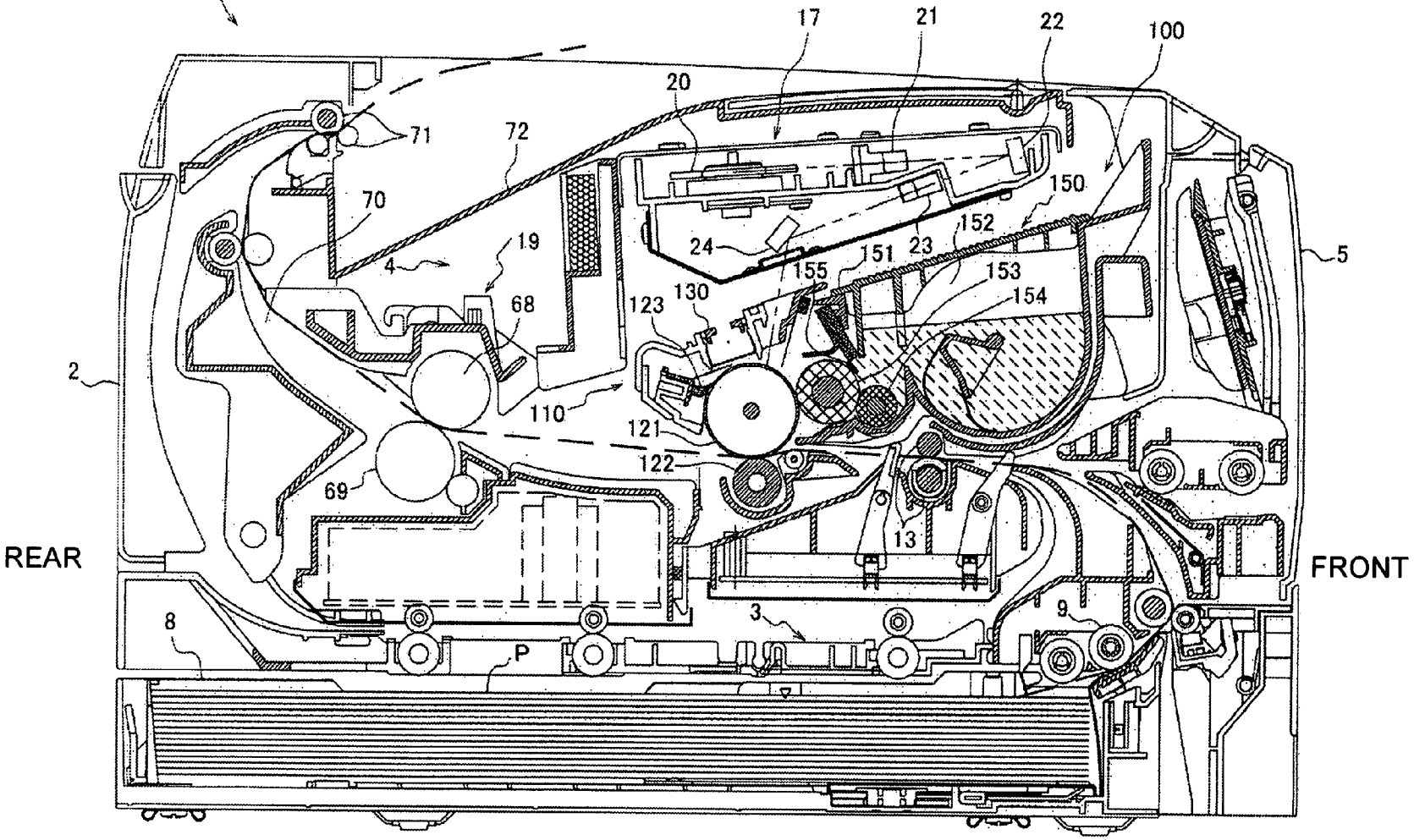
FIG. 1 is a side sectional view of a general structure of a laser printer as an image forming apparatus according to at least one aspect of the invention.

As shown in FIG. 1, a laser printer 1 as an image forming apparatus according to at least one aspect of the invention includes in a main body casing 2, a feeder portion 3 for feeding sheets P, which serve as a recording medium, and an image forming portion 4 for forming a specified image on a fed sheet P. In the following description, the right side of FIG. 1 is referred to as a front of the laser printer 1, and the left side of FIG. 1 is referred to as a rear of the laser printer 1.

On the front side of the main body casing 2, there is provided a front cover 5 that opens and shuts an opening through which a process cartridge 100 is inserted in or removed from the main body casing 2. Specifically, the front cover 5 is supported by the main body casing 2 in such a manner as to be rotatable on a cover shaft (not shown) inserted into the front cover 5 at a lower end portion thereof. When the front cover 5 is closed on the cover shaft, the opening 6 is closed by the front cover 5. When the front cover 5 is opened (tilted) on the cover shaft, the opening is opened by the front cover 5, so that the process cartridge 100 can be inserted in or removed from the main body casing 2 via the opening 5.

The feeder portion 3 includes, at a bottom portion in the main body casing 2, a sheet supply tray 8, a sheet supply roller 9, and resister rollers 13. The sheet supply tray 8 is removably attachable. The sheet supply roller 9 is provided at an upper portion of the front end portion of the sheet supply tray 8. The resister rollers 13 are provided at an upper rear side of the sheet supply roller 9.

The sheet supply tray 8 is configured to hold a stack of sheets P as recording media. The sheets P held in the sheet supply tray 8 are separated one by one by a rotation of the sheet supply roller 9 and fed between the register rollers 13.

The register rollers 13 are paired and designed to feed a sheet P to a transfer position of the image forming portion 4 (which is a nip position between a photosensitive drum 121 and a transfer roller 122 and a position where a toner image on the photosensitive drum 121 is transferred onto the sheet P) after skewing of the sheet P is accounted for.

The image forming portion 4 includes a scanner portion 17, the process cartridge 100, and a fixing portion 19.

The scanner portion 17 is disposed at an upper portion in the main body casing 2. The scanner portion 17 includes a laser light source (not shown), a polygon mirror 20 that is rotatably driven, an fθ lens 21, a reflecting mirror 22, a cylindrical lens 23, and a reflecting mirror 24. In the scanner portion 17, as shown in a double-dotted chain line of FIG. 1, a laser beam emitted from the laser light source, based on print data, is deflected by the polygon mirror 20, passes through the fθ lens 21, is folded by the reflecting mirror 22, passes through the cylindrical lens 23, is bent downward by the reflecting mirror 24, and is then directed to and scanned at a high speed over a surface of the photosensitive drum 121 of the process cartridge 100, which will be described later.

The process cartridge 100 is configured to perform an image formation process (charging, developing, transfer, cleaning of the photosensitive drum 121), and detachably mounted to the main body casing 2 below the scanner portion 17. The process cartridge 100 includes a drum cartridge 110 and a developing cartridge 150 functioning as a developing device detachably mounted in the drum cartridge 110. (Refer to FIG. 3.)

The drum cartridge 110 is detachably attachable to the main body casing 2. The drum cartridge 110 holds the developing cartridge 150 at the front and includes the photosensitive drum 121 functioning as a charged object (an image holding member), a scorotron charger 130, a transfer roller 122, and a cleaning brush 123 at the rear.

The photosensitive drum 121 is formed by covering the drum body, which is a metal tube such as aluminum, with a photosensitive layer formed of an organic photoconductor that is predominantly composed of polycarbonate. The photosensitive drum 121 is rotatably driven in the same direction as the sheet P (namely, clockwise in FIG. 1) at a nip portion with the transfer roller 122.

The scorotron charger 130 is spaced a specified distance from the surface of the photosensitive drum 121 upstream from a contact position with a developing roller 153 (upstream with respect to the rotation direction of the photosensitive drum 121). A detailed structure of the scorotron charger 130 will be described later.

The transfer roller 122 is formed by covering a metal shaft member with a roller member made of a conductive elastic material (e.g. rubber). The transfer roller 122 is disposed to face and make contact with the photosensitive drum 121 vertically and form a nip with the photosensitive drum 121. A transfer bias is applied to the transfer roller 122.

The cleaning brush 123 is disposed at a back of the photosensitive drum 121 so that the brush end makes contact with the surface of the photosensitive drum 121.

On the other hand, the developing cartridge 150 is detachably mounted to the drum cartridge 110, and includes, in a housing 151, a toner chamber 152, the developing roller 153, a supply roller 154, and a layer-thickness regulating member 155.

The toner chamber 152 contains positively charged non-magnetic single-component toner as a developing agent. The toner used according to this illustrative aspect is a polymerized toner obtained through copolymerization of styrene-based monomers, such as styrene, and acryl-based monomers, such as acrylic acid, alkyl (C1-C4) acrylate, and alkyl (C1-C4) methacrylate, using a known polymerization method, such as suspension polymerization. A coloring agent, such as carbon black, and wax are added to the polymerized toner. An external additive, such as silica, may also be added to the polymerized toner to improve flowability.

The developing roller 153 is formed by covering a metal shaft member with a roller member made of a conductive elastic material (e.g. rubber). The developing roller 153 is disposed in contact with the photosensitive drum 121 from an opening formed in the housing 151. The developing roller 153 is driven to rotate in the same direction as the photosensitive drum 153 at a nip portion with the photosensitive drum 121 (namely, in an opposite direction to that of the photosensitive drum 121). A developing bias is applied to the developing roller 153.

The supply roller 154 is made by covering a metal shaft member with a roller member made of a conductive foaming material (e.g. sponge). The supply roller 154 is disposed in contact with the developing roller 153. The supply roller 154 is driven to rotate in an opposite direction to that of the developing roller 153 at a nip portion with the developing roller 153 (namely, in the same direction as the developing roller 153).

The layer-thickness regulating member 155 includes a blade body made of a metal leaf spring member and a pressing portion having a generally semicircular shape in cross section, provided at a free end of the blade body, and made of insulative silicone rubber. The blade body is supported at one end by the housing 151, and the pressing portion provided at the other end is pressed in contact with the surface of the developing roller 153 by an elastic force of the blade body.

The fixing portion 19 is disposed at the rear of the process cartridge 100 and includes a heat roller 68 and a pressure roller 69.

The heat roller 68 includes a metal tube coated made of aluminum or the like, and a halogen lamp for heating placed in the metal tube. The heat roller 68 is rotatably driven in the same direction as the sheet P (namely, clockwise in FIG. 1) at a nip portion with the pressure roller 69.

The pressure roller 69 is made by covering a metal shaft with a roller member made of a heat-resistant elastic member (e.g. rubber). The pressure roller 69 is disposed in a face-to-face relationship with the heat roller 49 so as to press against the heat roller 49 from underneath. The pressure roller 69 is rotated along with the rotation of the heat roller 68.

With this configuration, in the image forming portion 4, toner in the toner chamber 152 is supplied to the developing roller 153 through the rotation of the supply roller 154, while being positively and frictionally charged between the supply roller 154 and the developing roller 153. Toner supplied onto the developing roller 153 goes in between the pressing portion of the layer-thickness regulating member 155 and the developing roller 153. Along with the rotation of the developing roller 153, the toner is uniformly regulated to a specified thickness as a thin layer and carried on the developing roller 153.

The surface of the photosensitive drum 121 is uniformly, positively charged by the scorotron charger 130. Then, a laser beam from the scanner portion 17 is scanned at high speed on the surface of the photosensitive drum 121, so that an electrostatic latent image corresponding to image data is formed on the surface of the photosensitive drum 121.

With the rotation of the developing roller 153, the toner carried on the developing roller 153 and positively charged makes contact with the photosensitive drum 121 and is supplied to the electrostatic latent image formed on the photosensitive drum 121. Namely, the toner is supplied to and selectively carried in an exposure portion of the uniformly, positively charged surface of the photosensitive drum 121, where the potential has become low due to exposure to the laser beam. As a result, the latent image on the photosensitive drum 121 becomes visible. Thus, a toner image is formed on the photosensitive drum 121.

Then, the photosensitive drum 121 and the transfer roller 122 are rotated to pinch the sheet P therebetween, and the toner image carried on the surface of the photosensitive drum 121 is transferred onto the sheet P being fed between the photosensitive drum 121 and the transfer roller 122.

Paper dust of the sheet P adhered on the photosensitive drum 121 after the toner transfer is removed by the cleaning brush 123 sliding on the surface of the photosensitive drum 121 being rotated.

In the fixing portion 19, the toner transferred onto the sheet P is fixed by heat and pressure while the sheet P passes between the heat roller 68 and the pressure roller 69. The sheet P, where toner is fixed by heat, is conveyed to a sheet ejection path 70 that extends upward toward the top surface of the main body casing 2. The sheet P conveyed to the sheet ejection path 70 is ejected by ejection rollers 71, disposed at an upper end of the sheet ejection path 70, and is stacked on a sheet discharge tray 72 formed on the top surface of the main body casing 2.

Scorotron Charger Structure

The structure of the scorotron charger 130, which is a constituent part of the process cartridge 100 (specifically, the drum cartridge 110) will be described with reference to FIGS. 2A and 2B.

Figure 2A:
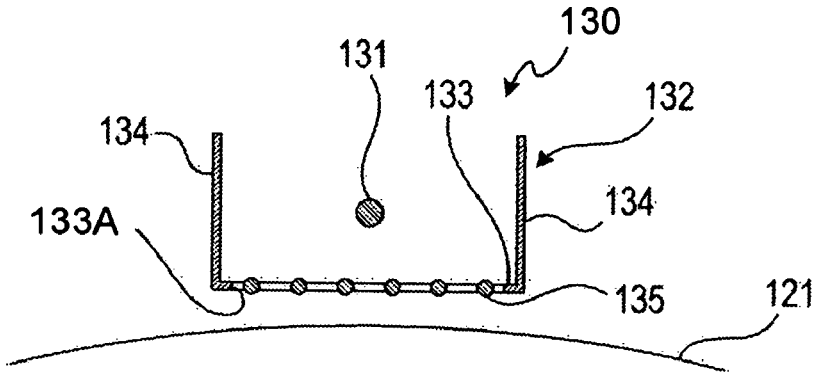
FIGS. 2A and 2B are explanatory views showing a structure of a scorotron charger according to at least one aspect of the invention.

FIG. 2A is a cross-sectional view of the scorotron charger 130, which is perpendicular to an axial direction of the photosensitive drum 121. FIG. 2B is a plan view of the scorotron charger 130 viewed from the photosensitive drum 121 (a plan view of a surface facing the photosensitive drum 121).

Figure 2B:
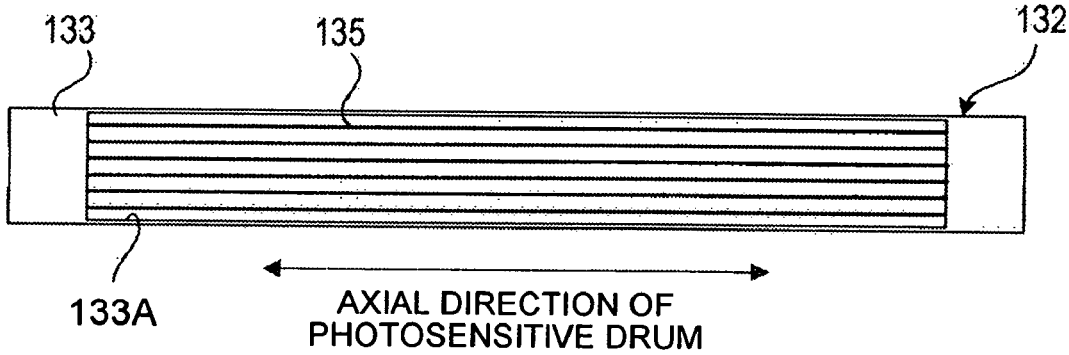

As shown in FIGS. 2A and 2B, the scorotron charger 130 includes a wire 131 and a shield member 132 that is spaced away from the wire 131.

The wire 131 is a tungsten wire, and is held taut in the axial direction of the photosensitive drum 121 at a fixed distance therefrom.

The shield member 132 is a metal plate generally shaped in a square bracket in cross section, and includes an opening formation plate 133 and a pair of opposed plates 134. The opening formation plate 133 is disposed between the wire 131 and the photosensitive drum 121, is rectangular in shape whose length is parallel to a direction that the wire 131 is held taut (that is the axial direction of the photosensitive drum 121). The plates 134 extend vertically from long sides of the opening formation plate 133 and are disposed opposite to each other to interpose the wire 131 therebetween. The opening formation plate 133 is formed with a rectangular opening 133A in which wires 135 are held taut in the axial direction of the photosensitive drum 121 and thus a grid electrode is formed.

With this structure, in the scorotron charger 130, when the wire 131 is subjected to voltage, it discharges corona ions by a corona discharge, the discharged corona ions pass the opening 133A to charge the surface of the photosensitive drum 121. At this time, an amount of corona ions passing through (or potential of a charged surface of the photosensitive drum 121) is controlled by applying voltage to the grid electrode.

Detachable Structure of the Wire

The following will describe how the wire 131 is attached to and removed from the drum cartridge 110.

Figure 3:
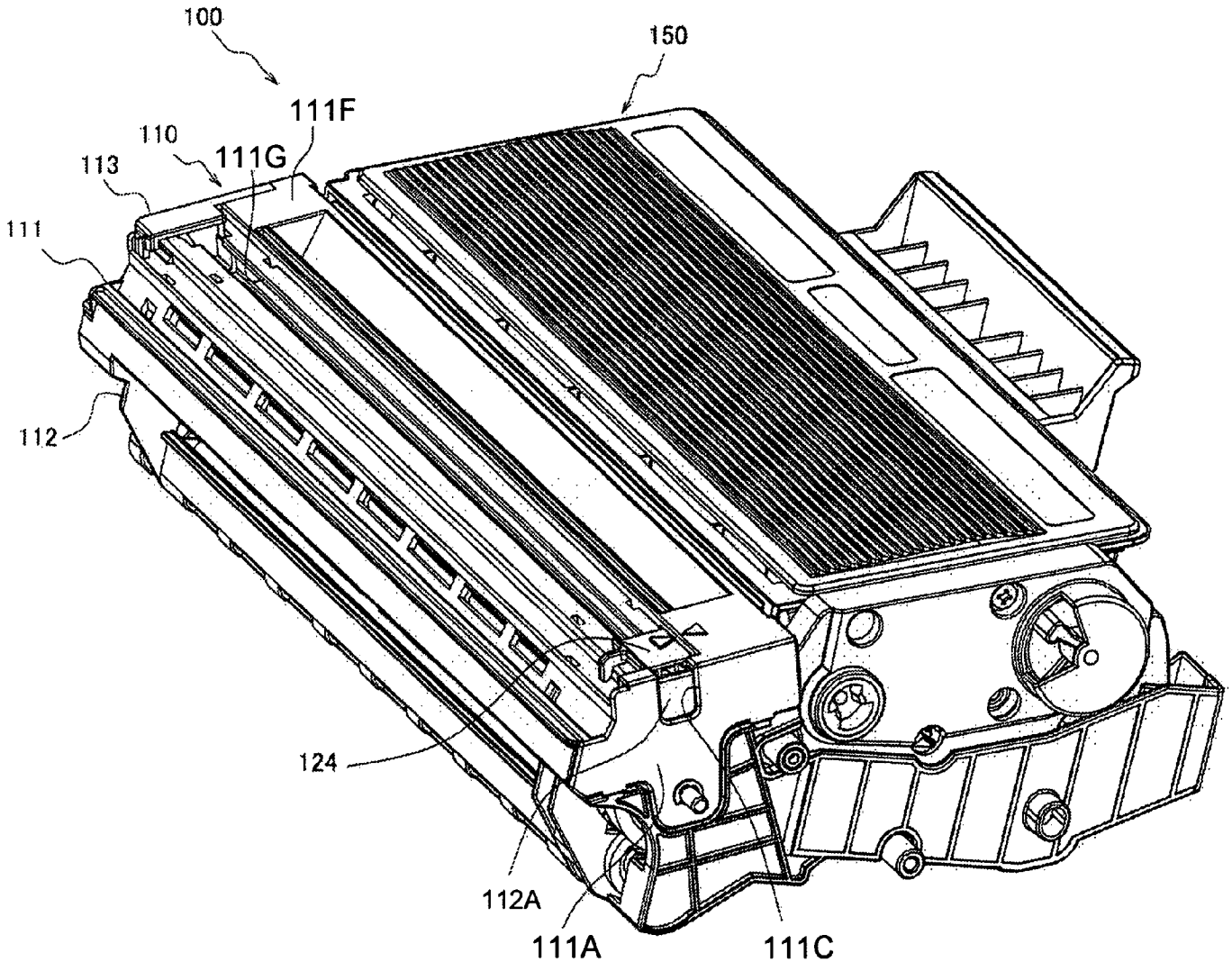
FIG. 3 is a perspective view of a process according to at least one aspect of the invention.
Figure 4A:
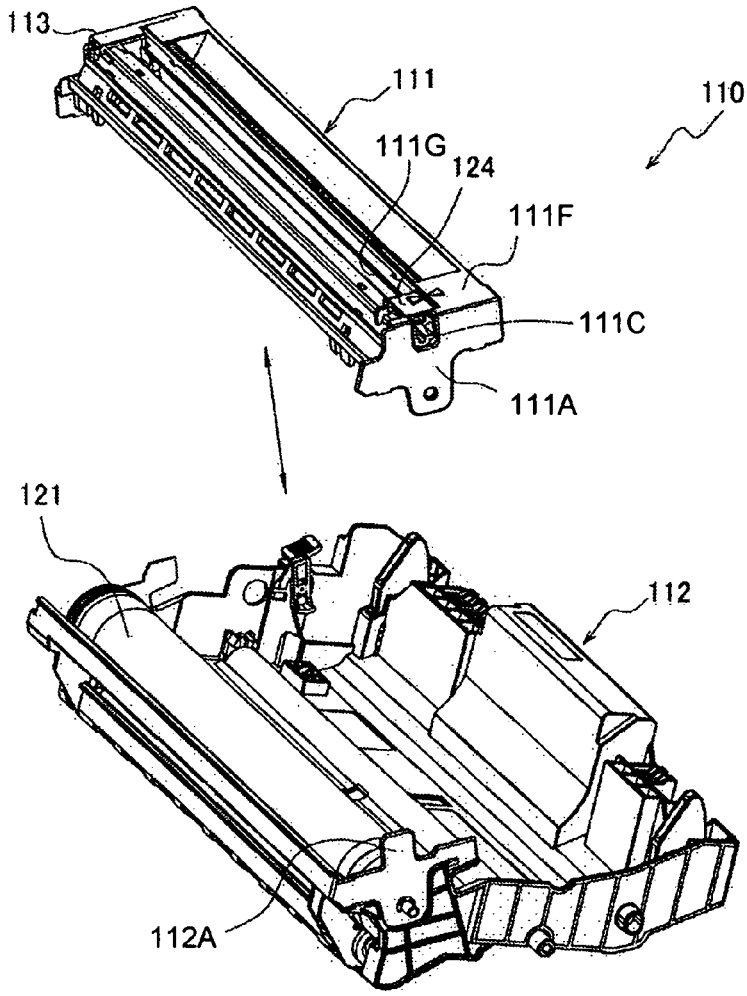
FIGS. 4A and 4B are explanatory views showing a structure of a drum cartridge according to at least one aspect of the invention.
Figure 4B:
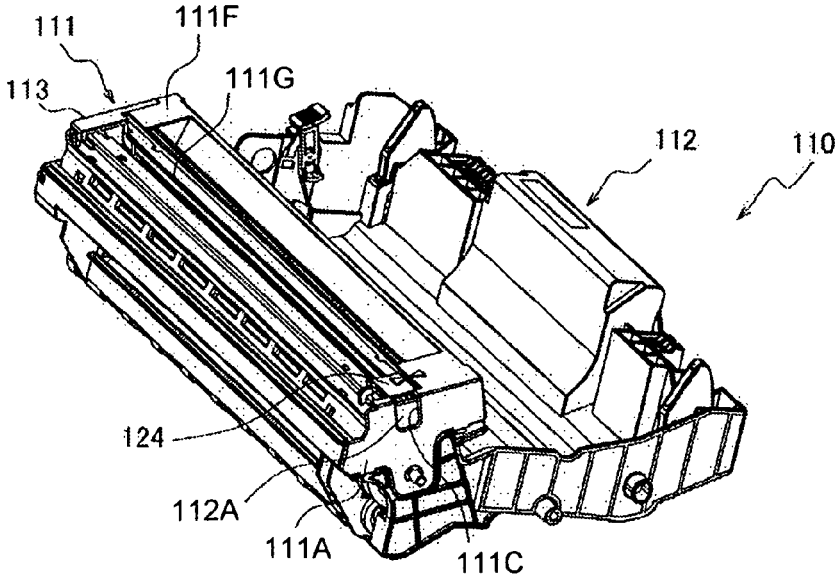
Figure 5A:
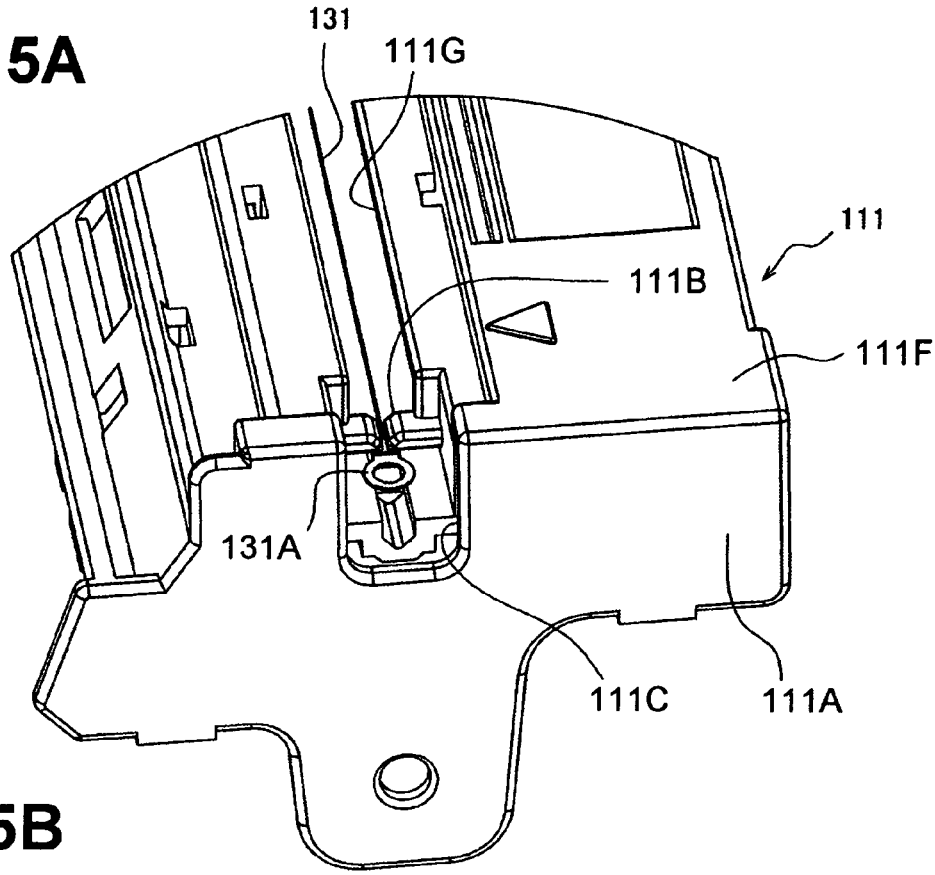
FIGS. 5A and 5B are explanatory views showing fixing places of a wire in a situation where a wire cleaner and an auxiliary frame are not shown according to at least one aspect of the invention.
Figure 5B:
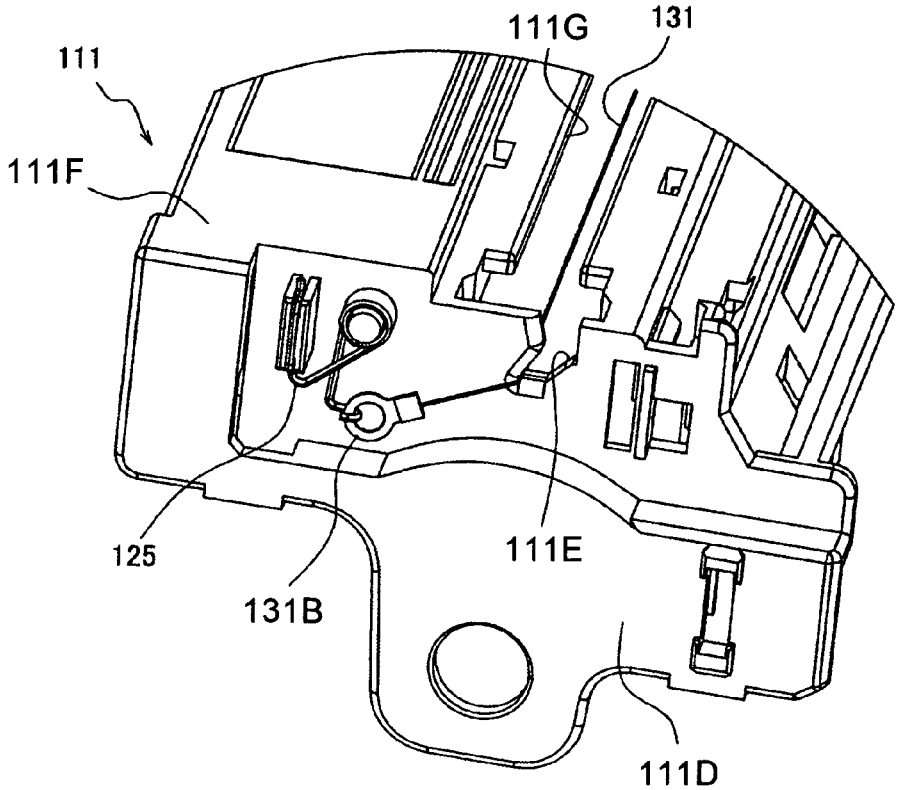
Figure 6:
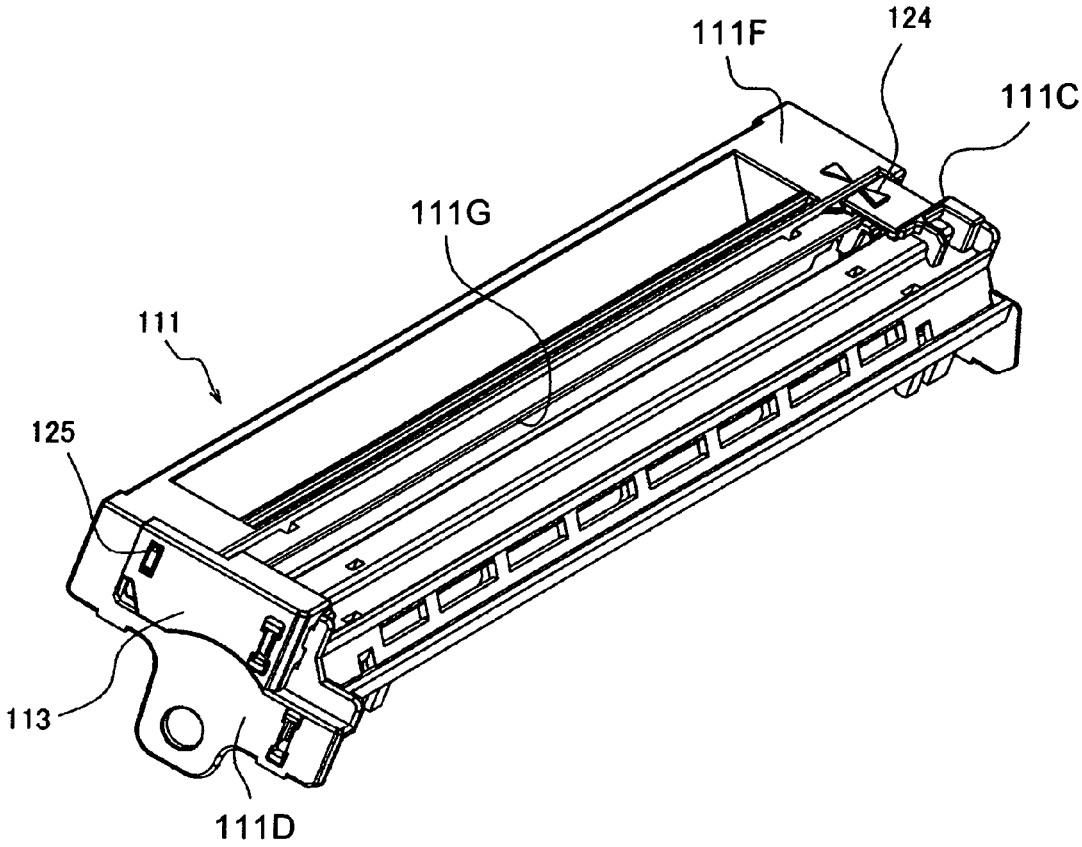
FIG. 6 is a perspective view of an upper frame of the drum cartridge according to at least one aspect of the invention.

FIG. 3 is a perspective view of the process cartridge 100. FIG. 4A is a perspective view of the drum cartridge 110 in a situation that an upper frame 111 is removed from a lower frame 112. FIG. 4B is a perspective view of the drum cartridge 110 in a situation that the upper frame 111 is mounted to the lower frame 112. FIG. 5A is an enlarged view showing one end of the upper frame 111 where a wire cleaner 124 is not shown. FIG. 5B is an enlarged view showing the other end of the upper frame 111 where an auxiliary frame 113 is not shown. FIG. 6 is a perspective view of the upper frame 111 viewed from a direction different from that of FIG. 4B.

As shown in FIGS. 4A and 4B, the drum cartridge 110 includes the lower frame 112 and the upper frame 111, which make up a casing of the drum cartridge 110. The lower frame 112 is made of a resin and shaped in an open-top box. The upper frame 111 is made of a resin, shaped in an open-bottom box, and detachably mounted to an upper portion of a rear end of the lower frame 112 (or an upper portion of the photosensitive drum 121 installed in position). The scorotron charger 130 is accommodated in the upper frame 111. The photosensitive drum 121, the transfer roller 122 and the cleaning brush 123 are accommodated in the lower frame 112.

The scorotron charger 130 is supported by the upper frame 111 with its upper portion (an open side in the shield member 132, and an opposite side to the photosensitive drum 121) covered. Specifically, the wire 131 of the scorotron charger 130 includes fixing members 131A, 131B, which are annular metal plates, at both ends as shown in FIGS. 5A and 5B. Thus, the wire 131 is supported directly by the upper frame 111 by fixing the fixing members 131A, 131B at both ends with respect to a width of the upper frame 111 (with respect to the direction that the wire 131 is held taut and that is the axial direction of the photosensitive drum 121).

That is, as shown in FIG. 5A, one end of the wire 131 is fixed such that the fixing member 131A is hooked in a wire fixing groove portion 111B (having a width capable of inserting the wire 131 and incapable of inserting the fixing member 131A) formed adjacent to a side wall 111A that is provided at one side of the upper frame 111. The side wall 111A of the upper frame 111 is formed with a cut portion 111C through which the fixing position (that is, the wire fixing groove portion 111B) is exposed outside the upper frame 111 so that the wire 131 is detachably attachable from outside the upper frame 111. However, to prevent the wire 131 from being touched by the user under normal use, the cut portion 111C is hidden when the upper frame 111 is mounted to the lower frame 112 as shown in FIG. 4B. Specifically, as shown in FIG. 4A, the lower frame 112 is formed with a protrusion 112A in such a position as to enable the cut portion 111C to be hidden when the upper frame 111 is mounted. Thus, when the upper frame 111 is mounted to the lower frame 112 (under normal use), the fixing position of the wire 131 is covered with the protrusion 112A (FIGS. 3 and 4B), and when the upper frame 111 is removed from the lower frame 112, the fixing position of the wire 131 is exposed outside the upper frame 111 (FIGS. 4A and 5A).

As shown in FIG. 5B, the other end of the wire 131 is fixed such that the fixing member 131B is hooked to a metal spring 125 fixed at an outer surface of a side wall 111D via a cut portion 111E formed at the side wall 111D. The spring 125 has a function of applying tension to the wire 131 due to its elastic force and a function as a terminal to apply voltage to the wire 131 from a voltage application circuit (not shown) of the laser printer 1. In this way, the position to fix the fixing member 131B (that is, the spring 125) is exposed outside the upper frame 111 (FIG. 5B), so that the wire 131 is detachably attachable from outside the upper frame 111. However, to prevent the wire 131 from being touched by the user under normal use, the fixing position of the wire 131 is covered with an auxiliary frame 113 that is designed to be detachably mounted to the side wall 111D of the upper frame 111 as shown in FIG. 6. With this structure, when the auxiliary frame 113 is mounted to the upper frame 111 (under normal use), the fixing position of the wire 131 is covered with the auxiliary frame 113 (FIG. 6), and when the auxiliary frame 113 is removed from the upper frame 111, the fixing position of the wire 131 is exposed outside the upper frame 111 (FIG. 5B).

A top wall 111F of the upper frame 111 is formed with a groove portion 111G that extends from the one side wall 111A to the other side wall 111D along the direction that the wire 131 is held taut so as to release the upper portion of the wire 131 (the open side of the shield member 132). With this structure, the wire 131 can be removed in a direction perpendicular to the direction that the wire 131 is held taut by removing the fixing members 131A and 131B, which are provided at both ends of the wire 131. The groove portion 111G is formed in such a constant width as not to allow a finger of the user to enter, except for both ends (near the fixing portions of the wire 131). The groove portion 111G is configured to prevent the wire 131 from being touched via the groove portion 111G from outside the upper frame 111.

The groove portion 111G includes a wire cleaner 124 that is slidable along the groove portion 111G. The wire cleaner 124 includes a cleaner member that is bent across the wire 131 and made of a foam material (e.g. sponge), and an operation member for moving the cleaner member by sliding it along the groove portion 111G (or the wire 131). By sliding the wire cleaner 124, the wire 131 is cleaned. The wire cleaner 124 is disposed at an end of the groove portion 111G (where the cut portion 111C is formed) to cover the fixing position of the wire 131 (that is, the wire fixing groove portion 111B) from above (FIGS. 4A, 4B, and 6).

As described above, the laser printer 1 according to aspects of the invention is configured so that the wire 131 of the scorotron charger 130 is detachably attachable with the shield member 132 of the scorotron charger 130 accommodated in the drum cartridge 110 (more specifically, the upper frame 111). Thus, according to the laser printer 1, the wire 131 only can be replaced without a need to replace the shield member 132, with the result that the shield member 132 can be efficiently used. Moreover, as the wire 131 can be attached or removed without a need to remove the shield member 132 from the drum cartridge 110 (more specifically, the upper frame 111), the shield member 132 can be prevented from getting soiled or breaking.

In the laser printer 1, the spring 125 that applies tension to the wire 131 is used as a terminal for applying voltage to the wire 131. Thus, there is no need to provide a terminal exclusively for applying voltage to the wire 131, and the number of parts can be reduced.

Moreover, in the laser printer 1, the fixing positions on both ends of the wire 131 are covered with the protrusion 112A of the lower frame 112 and the auxiliary frame 113, respectively under normal use of the drum cartridge 110. Thus, under normal use, the wire 131 can be prevented from being touched by the user. On the other hand, when the wire 131 is removed, the upper frame 111 is removed from the lower frame 112, the auxiliary frame 113 is removed from the upper frame 111, and the fixing members 131A and 131B on both ends of the wire 131 are exposed, with the result that the wire 131 only can be easily attached to and removed from the upper frame 111.

Particularly, as the protrusion 112A, which covers the fixing position of the wire 131 (that is, the wire fixing groove portion 111B) from the side, is constituted as a part of the lower frame 112, there is no need to provide an exclusive member additionally, and the number of parts can be reduced.

The laser printer 1 in other aspects of the invention has substantially the same general structure and the scorotron charger structure as those in the aspects described above but differs in structure in that the wire 131 is attached and removed. The following description will be provided to the different structure. It is noted that elements similar to or identical with those shown in and described in the above aspects are designated by similar numerals, and thus the description thereof will be omitted for the sake of brevity.

Detachable Structure of the Wire

Figure 7:
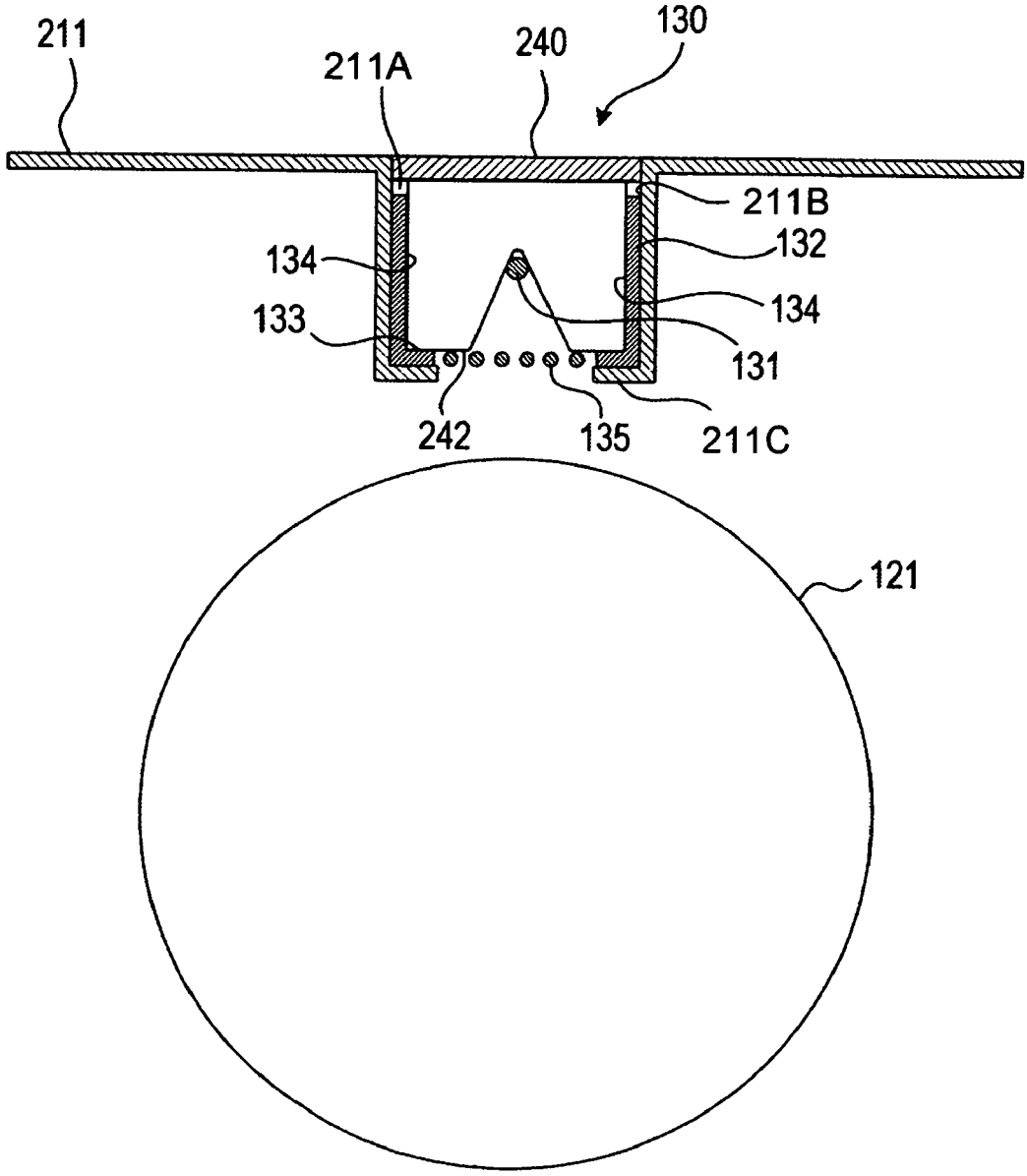
FIG. 7 is an explanatory view showing a detachable structure of a scorotron charger according to according to at least one aspect of the invention.
Figure 8A:
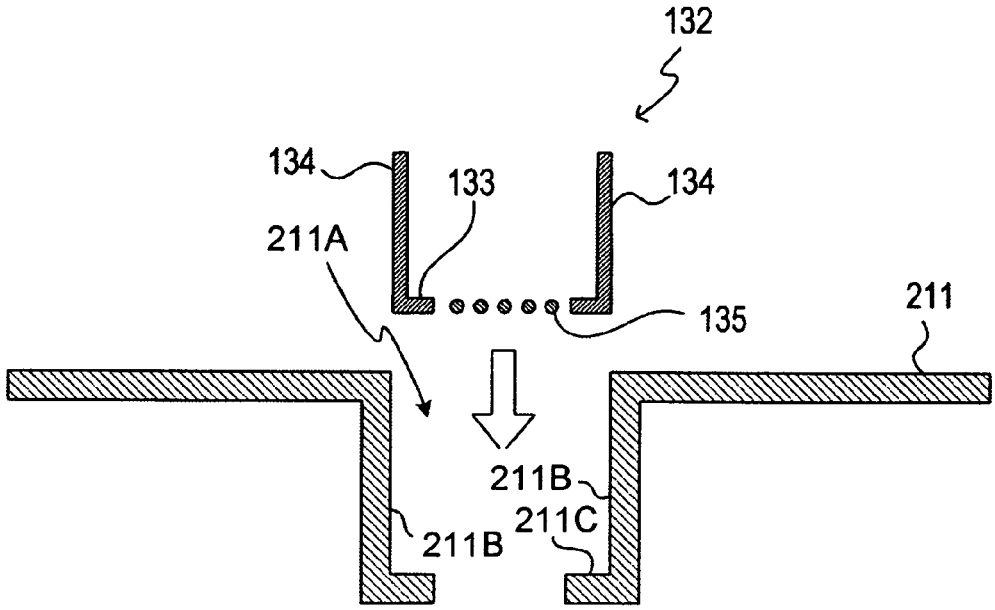
FIGS. 8A and 8B are explanatory views showing how the scorotron charger is detachably mounted according to at least one aspect of the invention.
Figure 8B:
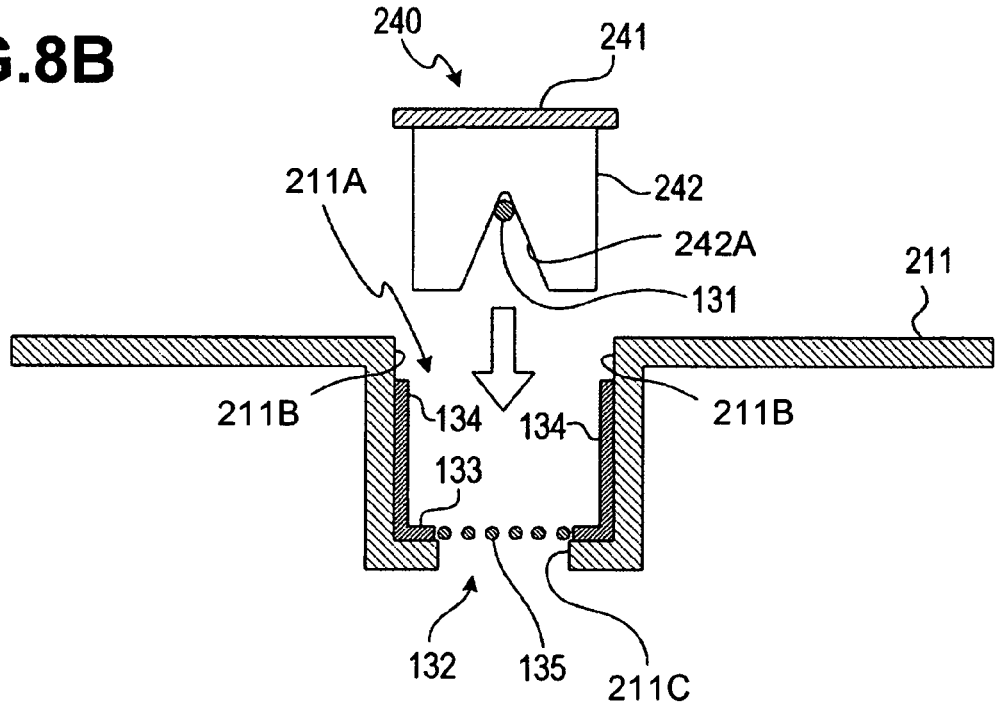
Figure 9:
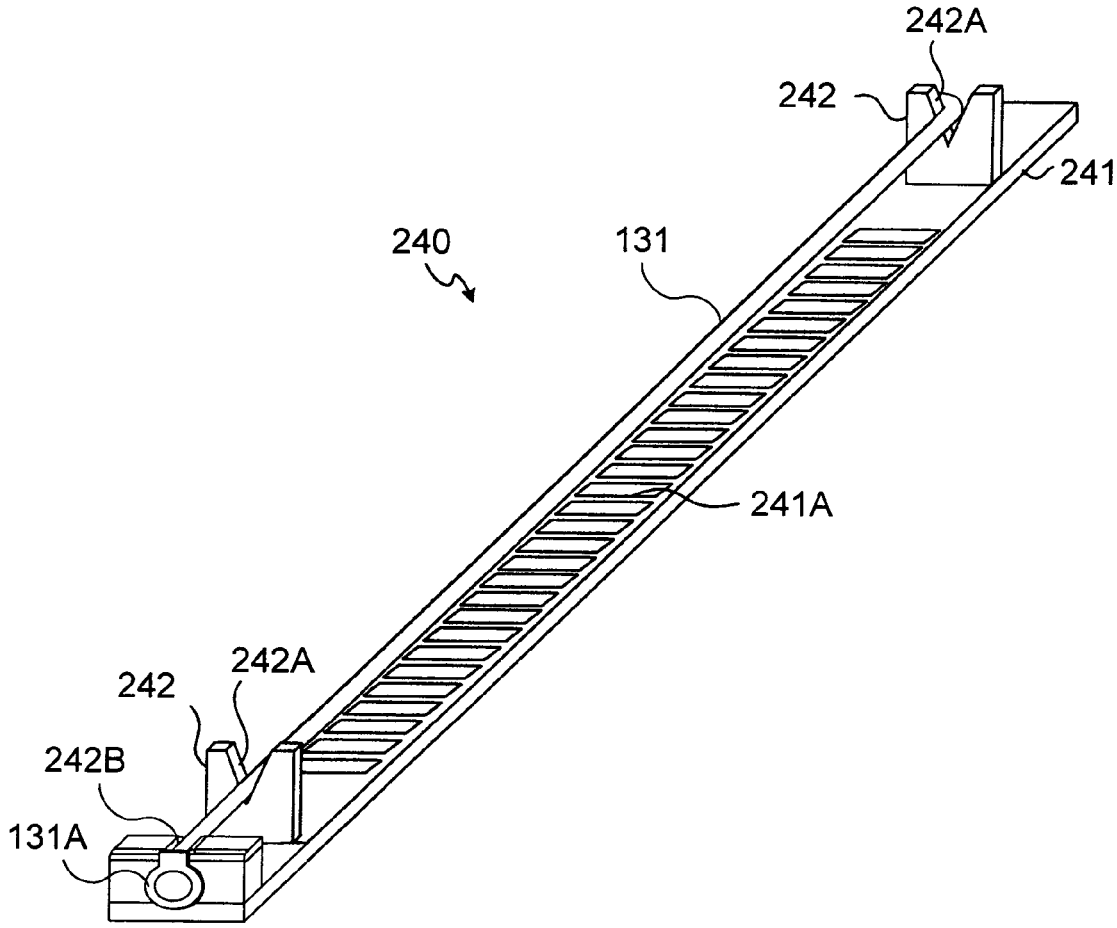
FIG. 9 is a perspective view of a wire supporting member according to at least one aspect of the invention.

FIG. 7 is an explanatory view showing a detachable structure of the scorotron charger 130 according to aspects of the invention. FIG. 8A is a cross sectional view showing how the shield member 132 is attached to and removed from an upper frame 211. FIG. 8B is a cross sectional view showing how the wire 131 and a wire supporting member 240 are attached to and removed from the upper frame 211. FIG. 9 is a perspective view of the wire supporting member 240.

As shown in FIGS. 7, 8A and 8B, in the laser printer 1, the scorotron charger 130 is accommodated in an accommodating portion 211A formed on a top surface of the upper frame 211, which is made of a resin and constituted as a casing of the drum cartridge 110.

The accommodating portion 211A is formed with side walls 211B and a regulating portion 211C. The side walls 211B make contact with outer surfaces of the opposed plates 134 of the shield member 132, and the regulating portion 211C makes contact with a periphery portion of the opening formation plate 133 of the shield member 132 to regulate the motion of the shield member 132 toward the photosensitive drum 121. With this structure, the shield member 132 accommodated in the accommodating portion 211A can be prevented from being deformed outward.

In the accommodating portion 211A where the shield member 132 is already accommodated, the wire supporting member 240 is accommodated. The wire supporting member 240 supports the wire 131 of the scorotron charger 130 and holds the shield member 132 in an enclosing manner with the upper frame 211.

As shown in FIG. 9, the wire supporting member 240 includes a lid plate 241 and two supporting plates 242, which are integrally formed of resin. The lid plate 241 is shaped in a rectangle that is long in the direction that the wire 131 is held taut (in other words, in the axial direction of the photosensitive drum 121). The supporting plates 242 are vertically arranged on a surface of the lid plate 241 face to face with each other. The wire supporting member 240 is accommodated in the accommodating portion 211A of the upper frame 211 and disposed in such a position as to enable the wire supporting member 240 to cover the open side of the shield member 132. The lid plate 241 is formed with a number of slits 241A, which function as intakes for efficiently flowing corona irons discharged from the wire 131 to the photosensitive drum 121.

Each of the supporting plates 242 is designed to position the wire 131 and is disposed adjacent to each end of the lid plate 241 with respect to the length thereof so as to make contact with the wire 131 in a non-image formation area on the photosensitive drum 121, which is located outside a portion contributing to image formation in the wire 131 (or a portion opposite to an image formation area on the photosensitive drum 121). Each supporting plate 242 is formed with a V-shaped cut portion 242A, and the wire 131 is positioned via the V-shaped cut portion 242A. The wire 131 includes the fixing members 131A, 131B at both ends, and the fixing members 131A, 131B are fixed by the wire supporting member 240 outside the respective supporting plates 242. Specifically, the wire 131 is fixed to the wire supporting member 240 so that the fixing member 131A at one end is hooked to a wire fixing groove portion 242B formed in the wire supporting member 240 and the fixing member 131B at the other end is hooked to a spring (not shown) provided to the wire supporting member 240.

Each supporting plate 242 is shaped to make contact with facing surfaces (or inner surfaces) of the opposed plates 134 of the shield member 132 when the wire supporting member 240 is accommodated in the accommodating portion 211A of the upper frame 211 (to have a width substantially equal to a distance between the opposed plates 134) as shown in FIG. 7. Thus, the shield member 132 is pinched and supported between the upper frame 211 and the wire supporting portion 240, so that it can be prevented from being deformed.

With such a structure, as shown in FIG. 8B, the wire 131 is detachably attachable to the upper frame 211, integrally with the wire supporting member 240. As shown in FIG. 8A, the shield member 132 is detachably attachable to the upper frame 211 when the wire supporting member 240 is removed from the upper frame 211.

As described above, the laser printer 1 can be configured so that the wire 131 of the scorotron charger 130 is detachably attachable to the drum cartridge 100 (more specifically, the upper frame 211) with the shield member 132 of the scorotron charger 130 accommodated in the drum cartridge 100. Thus, according to the laser printer 1, the wire 131 can be replaced without a need to replace the shield member 132, with the result that the shield member 132 can be efficiently used. Moreover, as the wire 131 can be attached or removed without a need to remove the shield member 132 from the drum cartridge 110 (more specifically, the upper frame 111), the shield member 132 can be prevented from getting soiled or damaged. Since there is no need to disassemble the casing of the drum cartridge 100, the wire 131 can be attached and removed relatively easily.

In the laser printer 1, the wire supporting member 240 is provided separately from the upper frame 211, so that the wire supporting member 240 can be formed of a material different from that of the upper frame 211. For example, while the wire supporting member 240 may be formed of a conductive resin to apply voltage to the wire 131 via the wire supporting member 240, the upper frame 211 may be formed of a non-conductive resin, which is generally inexpensive compared with the conductive resin.

Moreover, in the laser printer 1, the wire supporting member 240 is configured to be detachably attachable to the upper frame 211, integrally with the wire 131. Thus, the wire 131 can be easily attached (in particular) and removed, compared with a structure where the wire 131 only is attached to or removed from the upper frame 211.

The wire supporting member 240 is configured to position the wire 131 via the V-shaped cut portions 242A. Thus, the installation of the wire 131 is simplified, and the wire 131 can be prevented from wobbling. For example, if the wire 131 is positioned via a groove of constant width, the groove should have a constant width that is adequate to insert the wire 131 and prevent the wire 131 from wobbling. Thus, it can be difficult to install (or insert) the wire 131 in the groove and the wire 131 may wobble greatly in the installation position according to a dimension error. In contrast, a V-shaped cut portion facilitates the installation of the wire 131 and may prevent the wire 131 from wobbling.

In addition, as the wire supporting member 240 is configured to support the wire 131 in the non-image formation area, it preserves the function the wire 131 has.

In the laser printer 1, the wire supporting member 240 is shaped to make contact with the facing surfaces (or the inner surfaces) of the opposed plates 134 of the shield member 132. The shape prevents the opposed plates 134 from inclining inward. Since the wire supporting member 240 is used for preventing the opposed plates 134 from inclining inward, there is no need to provide an exclusive member additionally, and the number of parts can be reduced.

In the laser printer 1, when the wire supporting member 240 is removed from the upper frame 211, the shield member 132 is detachably supported by the upper frame 211. When the wire supporting member 240 is accommodated in the upper frame 211, the shield member 132 is held in an enclosed manner between the wire supporting member 240 and the upper frame 211. Thus, the shield member 132 can be prevented from being deformed. In addition, as the wire supporting member 240 is used to hold the shield member 132 in an enclosing manner, there is no need to provide an exclusive member additionally, and thus the number of parts can be reduced. Moreover, the structure is that the shield member 132 can be attached or removed after the wire supporting member 240 is removed from the upper frame 211. Thus, this structure can be simplified when compared with a structure in which the shield member 132 only can be attached or removed regardless of whether the wire supporting member 240 is accommodated in the upper frame 211.

Other Illustrative Aspects

While the invention has been described with reference to certain illustrative aspects, it is to be understood that the invention is not restricted to the particular forms shown and described therein. Various modifications and alterations can be made thereto without departing from the scope of the invention.

Although the laser printer 1 can use the spring 125 to apply tension to the wire 131 as a terminal for applying voltage to the wire 131, aspects of the invention are not limited to the details of the illustrated aspects. A discharge electrode may generally be used as a terminal. For example, a discharge electrode shown in FIG. 10 may be used instead of the wire 131 used in the laser printer 1 of some aspects describe above.

Figure 10A:
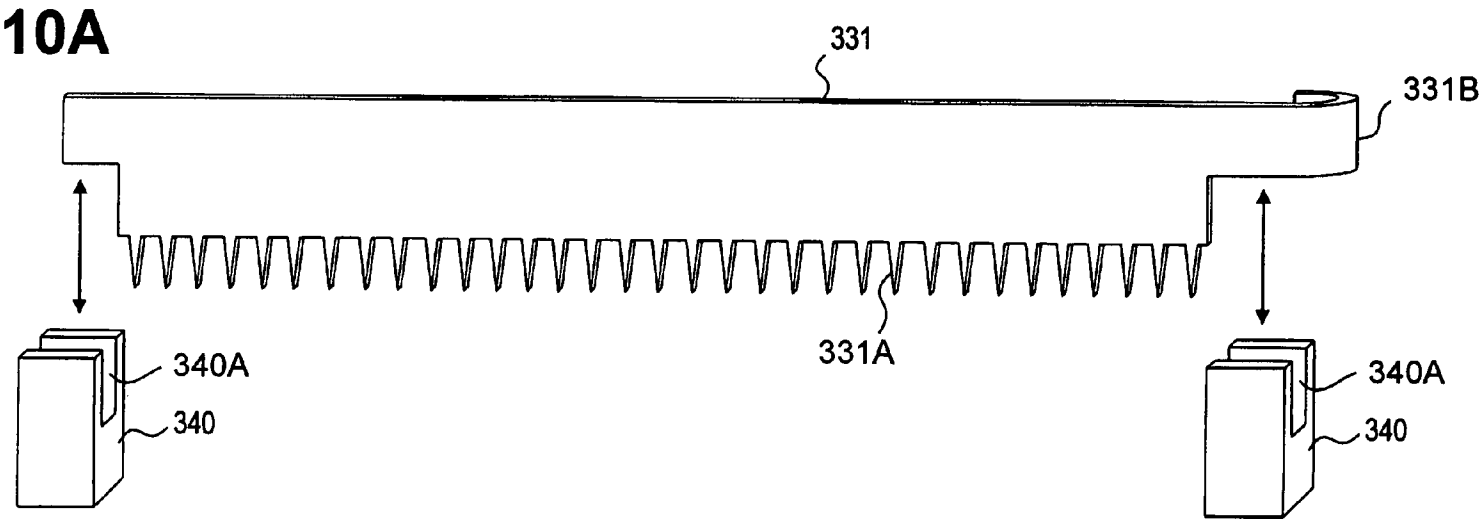
FIGS. 10A and 10B are explanatory views of a discharge electrode whose one end functions as a terminal according to at least one aspect of the invention.
Figure 10B:
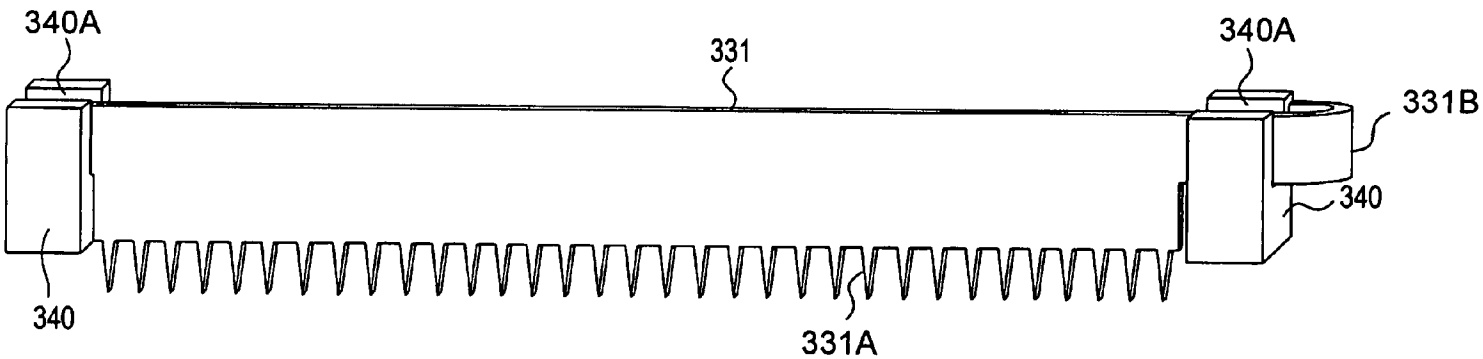

An aspect of a discharge electrode whose one end is exposed outside of the frame and functions as a terminal will be described with reference to FIGS. 10A and 10B. FIGS. 10A and 10B are explanatory views of a saw-toothed electrode 331 as an example of such a discharge electrode.

As can be seen, the saw-toothed electrode 331 is formed with a number of needles 331A and a U-shaped bend portion 331B at one end. The saw-toothed electrode 331 is a metal plate. The saw-toothed electrode 331 is configured so that it is supported at both ends by two supporting members 340 having groove portions 340A in which the saw-toothed electrode 331 is inserted, and the bend portion 331B of the saw-toothed electrode 331 is exposed outside the supporting member 340. With this configuration, the bend potion 331B of the saw-toothed electrode 331 can be used as a terminal.

The laser printer 1 can be configured so that the wire supporting member 240 that supports the wire 131 of the scorotron charger 130 is provided separately from the upper frame 211 of the drum cartridge 110 and the wire supporting member 240 is detachably attachable together with the wire 131. However, aspects of the invention are not limited to the details of the illustrated aspects. For example, the wire 131 may be detachable solely.

Figure 11:
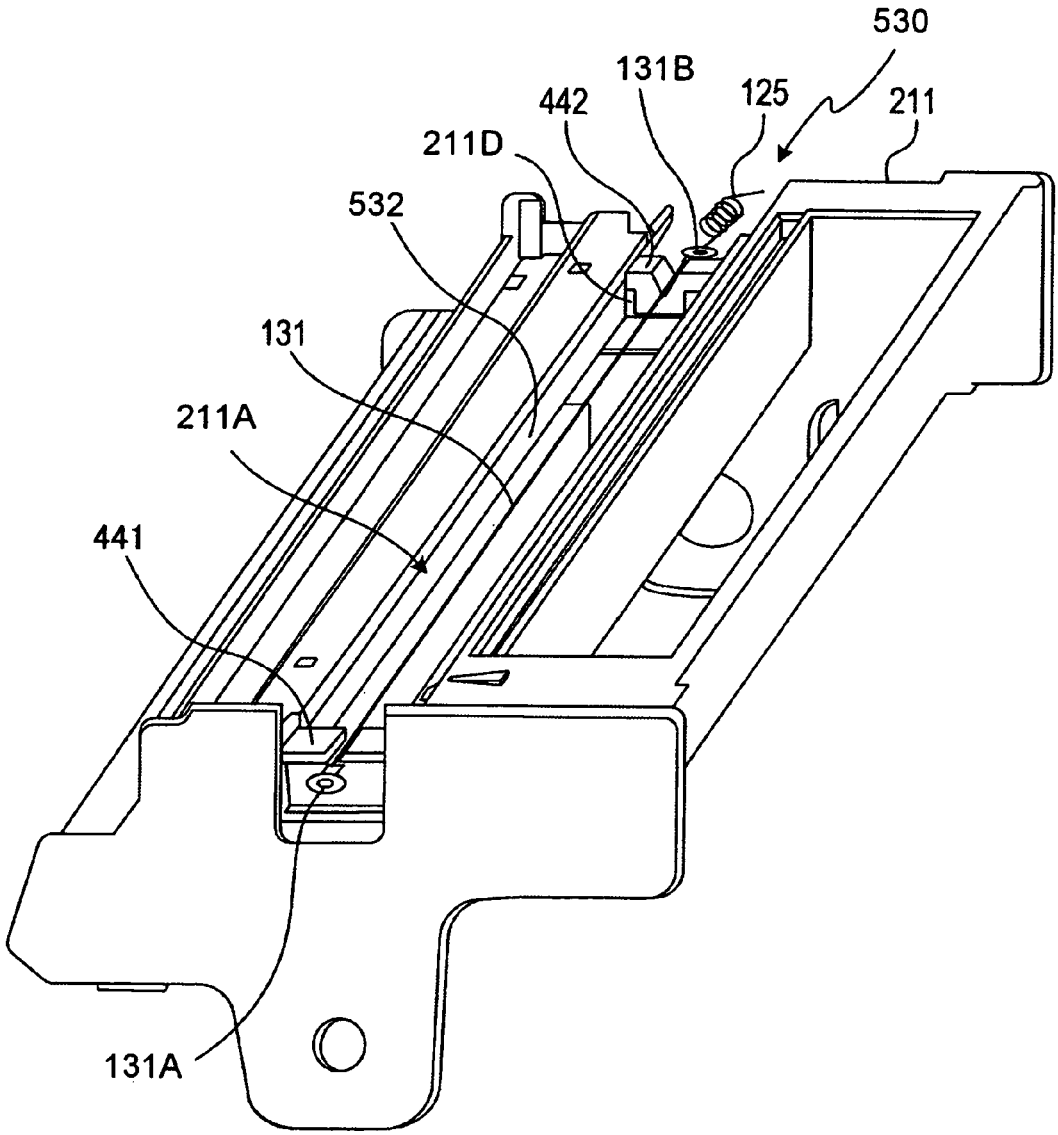
FIG. 11 is an explanatory view showing a detachable structure of a scorotron charger according to another aspect of the invention.
Figure 12:
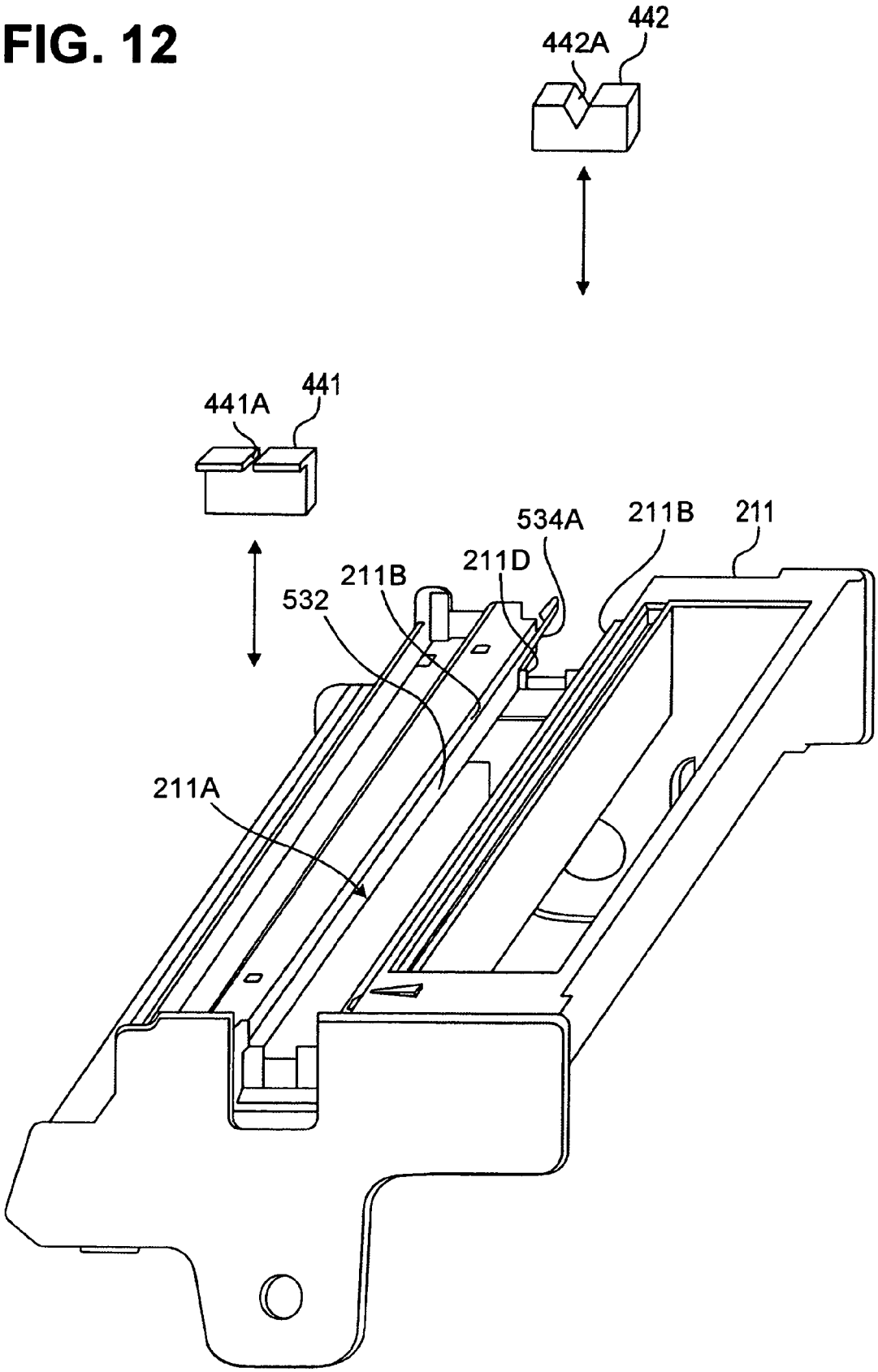
FIG. 12 is an explanatory view showing how wire supporting members are detachably mounted according to at least one aspect of the invention.
Figure 13:
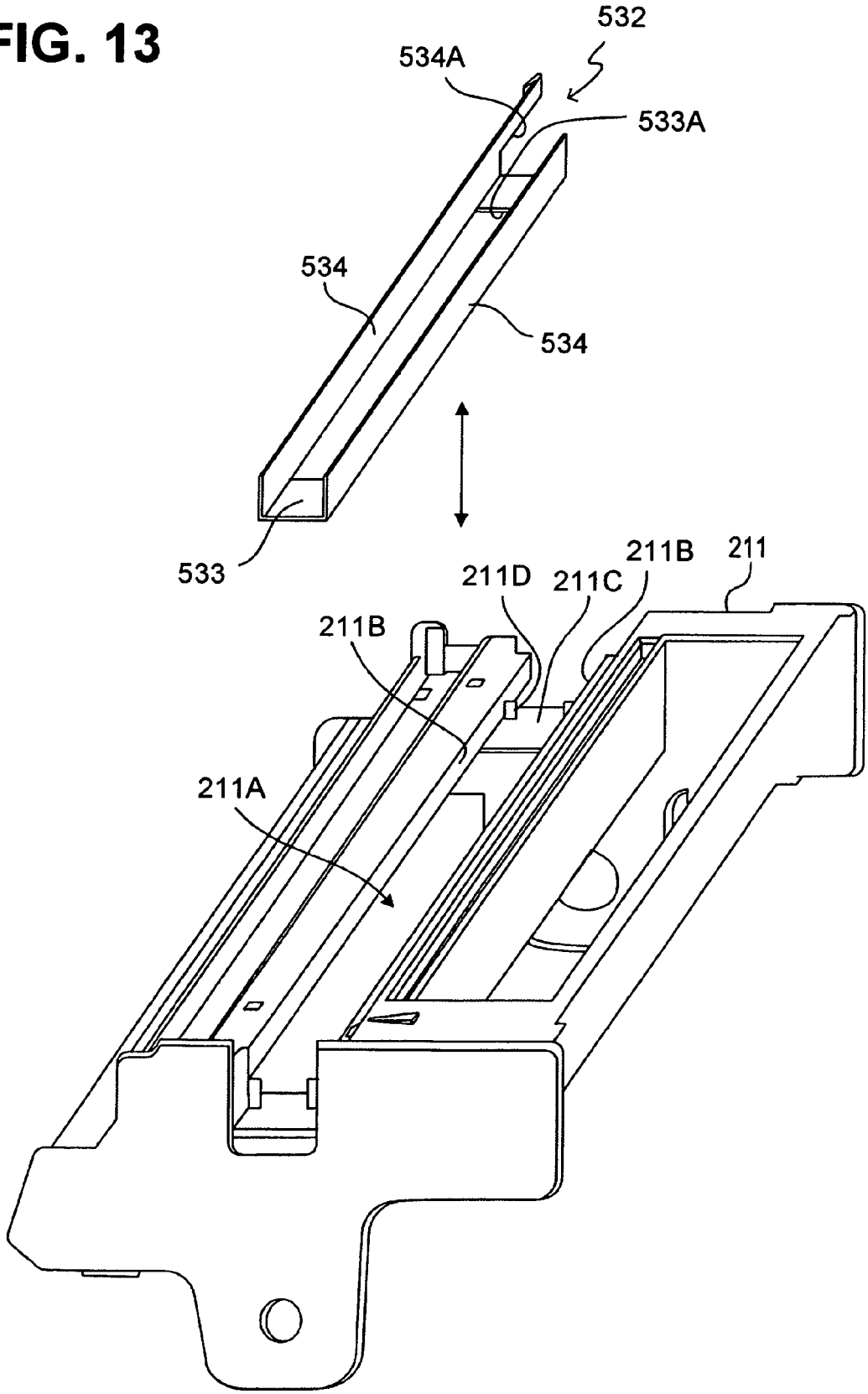
FIG. 13 is an explanatory view showing how a shielding member is detachably mounted according to at least one aspect of the invention.
Figure 14:
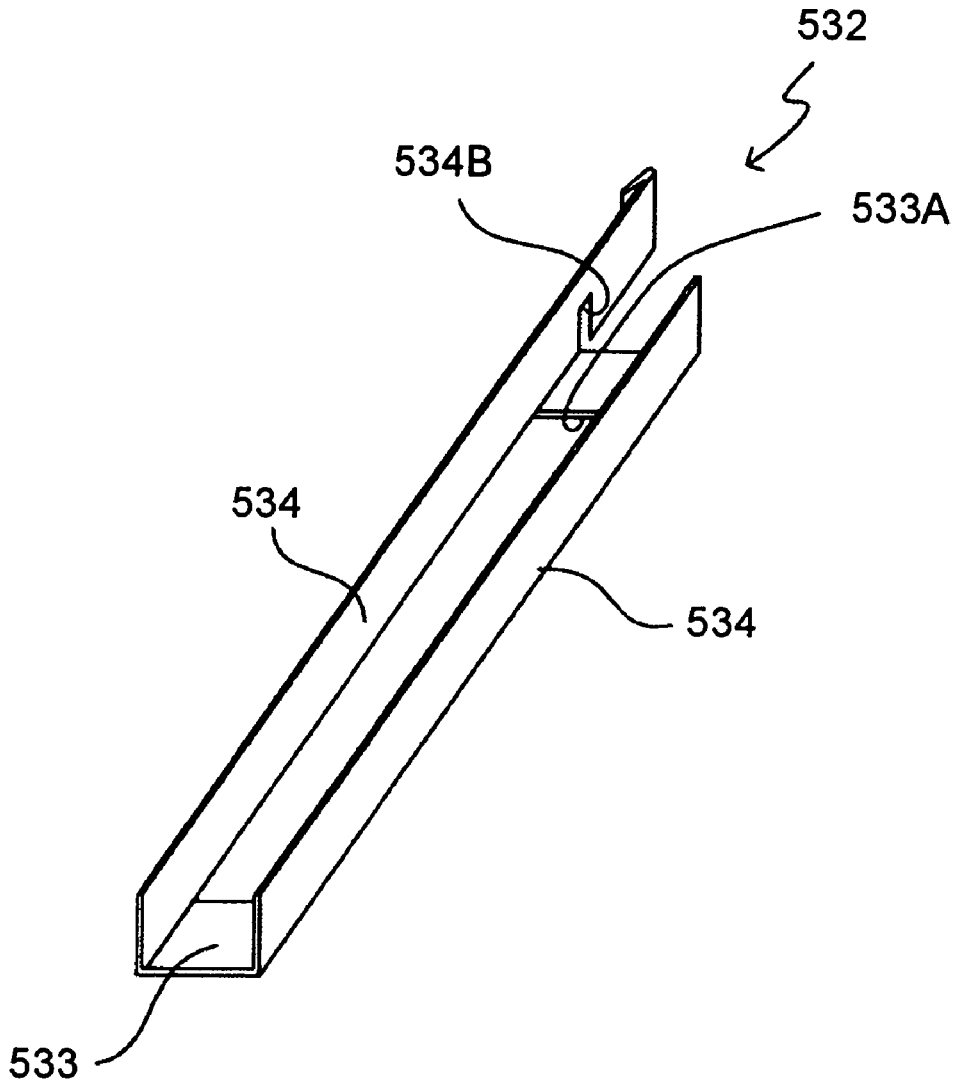
FIG. 14 is a perspective view of the shielding member according to at least one aspect of the invention.

FIG. 11 is a perspective view of the upper frame 211 with a modified scorotron charger 530 mounted. FIG. 12 is a perspective view showing how wire supporting members 441, 442 are attached to or removed from the upper frame 211. FIG. 13 is a perspective view showing how a shield member 532 is attached to or removed from the upper frame 211. FIG. 14 is a perspective view of a modification of the shield member 532.

As shown in FIGS. 11 to 13, the scorotron charger 530 is accommodated in the accommodating portion 211A formed on the top surface of the upper frame 211 that is made of resin and functions as a casing of the drum cartridge 110.

As shown in FIG. 13, the accommodating portion 211A is formed with the side walls 211B and the regulating portion 211C. The side walls 211B make contact with outer surfaces of opposed plates 534 of the shield member 532, and the regulating portion 211C makes contact with a periphery portion of an opening formation plate 533 of the shield member 532 to regulate the motion of the shield member 532 toward the photosensitive drum 121. One of the opposed plates 534 is formed with a cut portion 534A that makes contact with a regulating plate 211D vertically arranged on the bottom surface of the accommodating portion 211A of the upper frame 211 and regulates the motion of the shield member 532 in a longitudinal direction of the shield member 532 (or in the direction that the wires 131 are held taut). As shown in FIG. 14, the shield member 532 may include a groove portion 534B capable of receiving the regulating plate 211D instead of the cut portion 534A.

As shown in FIGS. 11 and 12, wire supporting members 441, 442 are accommodated in the accommodating portion 211A where the shield member 532 has been already accommodated. The wire supporting members 441, 442 support the wire 131 of the scorotron charger 530 and sandwich the shield member 532 with the upper frame 211.

The wire supporting member 441 is a resin member shaped in a rectangular solid with flanges that extend outward on an upper end thereof. On a top surface of the wire supporting member 441, there is a groove portion 441A for securing the fixing member 131A of the wire 131 in a hooked manner.

The wire supporting member 442 is a resin member shaped as a rectangular solid with a V-shaped cut portion 442A on a top surface thereof. The V-shaped cut portion 442A is used for positioning the wire 131. The fixing member 131B of the wire 131 is fixedly hooked to the metal spring 125 fixed on an outer surface of the upper frame 211. The wire supporting members 441, 442 are shaped to make contact with the facing surfaces (or the inner surfaces) of the opposed plates 534 of the shield member 532. When the wire supporting members 441, 442 are accommodated in the accommodating portion 211A of the upper frame 211, they make contact with the facing surfaces (or the inner surfaces) of the shield member 532. Thus, the shield member 532 is pinched and supported by the upper frame 211 and the wire supporting members 441, 442, so that its deformation can be prevented.

With such a structure, the wire 131 only is detachably attachable to the upper frame 211, and the shield member 532 becomes detachably attachable to the upper frame 211 with the wire supporting member 441, 442 removed.

Accordingly, the aspects of the invention, as set forth above, are intended to be illustrative, not limiting. Various changes may be made without departing from the spirit and scope of the invention. Therefore, aspects of the invention are intended to embrace all known or later developed alternatives, modifications, variations, improvements and/or substantial equivalents.

What is claimed is:

1. A cartridge comprising:

a frame having a first support portion and a second support portion, and a pair of opposed side walls, the side walls being spaced apart in a first direction and extending in a second direction crossing the first direction;

a photosensitive member;

a holding portion positioned outside the frame at one of the side walls of the frame;

a discharge induction electrode that is extended inside the frame; and a discharge electrode that is extended inside the frame in the first direction, the discharge electrode being positioned and supported by the first support portion and the second support portion, an end of the discharge electrode being releasably held by the holding portion, wherein each of the first support portion and the second support portion forms a shape having a notch opening in a direction opposite from the discharge induction electrode.

2. The cartridge according to claim 1, wherein the frame is open in the direction opposite from the discharge induction electrode.

3. The cartridge according to claim 1, wherein the holding portion includes a spring, and the spring is configured to apply tension to the discharge electrode.

4. The cartridge according to claim 3, wherein the spring is conductive.

5. The cartridge according to claim 1, wherein the discharge electrode includes a wire.

6. The cartridge according to claim 1, further comprising a cover member configured to cover the holding portion, wherein the cover member is disposed parallel to the one of the side walls of the frame.

7. The cartridge according to claim 1, further comprising a second frame configured to accommodate the photosensitive member therein, wherein the second frame includes a cover member configured to cover the holding portion.

8. An image forming apparatus comprising:

a cartridge including:

a frame having a first support portion and a second support portion, and a pair of opposed side walls, the side walls being spaced apart in a first direction and extending in a second direction crossing the first direction;

a photosensitive member;

a holding portion positioned outside the frame at one of the side walls of the frame;

a discharge induction electrode that is extended inside the frame; and a discharge electrode that is extended inside the frame in the first direction, the discharge electrode being positioned and supported by the first support portion and the second support portion, an end of the discharge electrode being releasably held by the holding portion;

wherein each of the first support portion and the second support portion forms a shape having a notch opening in a direction opposite from the discharge induction electrode.

9. A cartridge comprising:

a frame having a pair of opposed side walls spaced apart in a first direction;

a first support member;

a second support member spaced apart from the first support member in the first direction, the side walls extending in a second direction crossing the first direction;

a holding portion positioned outside the frame at one of the side walls of the frame;

a discharge induction electrode that is extended inside the frame; and a discharge electrode that is extended inside the frame in spaced parallel relation to the discharge induction electrode, the discharge electrode being positioned and supported by the first support member and the second support member, an end of the discharge electrode being releasably held by the holding portion.

10. The cartridge according to claim 9, wherein one of the first support member and the second support member is disposed in the one of the side walls.

11. The cartridge according to claim 9, wherein the first support member and the second support member are positioned between the side walls.

12. The cartridge according to claim 9, further comprising a support plate configured to be attached to and removed from the frame, wherein the first support member and the second support member are positioned on the support plate.

* * * * *